United States Patent [19]

Rice

[11] Patent Number: 4,901,745

[45] Date of Patent: Feb. 20, 1990

[54] TENT ASSEMBLY FOR ATTACHMENT TO A VAN

[76] Inventor: Dale D. Rice, 3500 W. Tillman St., Appleton, Wis. 54914

[21] Appl. No.: 378,643

[22] Filed: Jul. 12, 1989

[51] Int. Cl.[4] ..... E04H 15/06

[52] U.S. Cl. ..... 135/88; 135/90; 135/95; 135/117; 296/159

[58] Field of Search ..... 135/88, 95, 106, 114, 135/117, 90, 97; 296/157, 161, 164

[56] References Cited

U.S. PATENT DOCUMENTS

| | | | |
|---|---|---|---|
| 2,806,478 | 9/1957 | Sherbinin | 135/88 |
| 3,702,617 | 11/1972 | Franzen | 135/88 |
| 4,444,429 | 4/1984 | Dawes | 135/88 X |
| 4,465,316 | 8/1984 | Roisen | 135/88 X |
| 4,504,049 | 3/1985 | Straub | 135/88 X |

FOREIGN PATENT DOCUMENTS

| | | | |
|---|---|---|---|
| 0055228 | 6/1982 | European Pat. Off. | 135/88 |
| 2405746 | 8/1975 | Fed. Rep. of Germany | 135/88 |
| 567386 | 3/1974 | Switzerland | 135/88 |

*Primary Examiner*—David A. Scherbel
*Assistant Examiner*—Lan Mai
*Attorney, Agent, or Firm*—Andrus, Sceales, Starke & Sawall

[57] ABSTRACT

A camping tent assembly for attachment to a van or for freestanding use is of a generally L-shaped configuration for direct attachment to the rear and one side of the van. The interior side walls of the tent which are demountably attached to the van include access openings to the rear and side van doors and collars to seal the interface therebetween. The interior side walls may be detached from the van without collapsing the tent, the van moved away, and conventional tent supports substituted to completely restore the tent to and allow its use in a freestanding orientation. A portable galley unit stored in the rear of the van and directly accessible from inside the tent provides a camping assembly for complete cooking, sleeping and living needs.

14 Claims, 3 Drawing Sheets

TENT ASSEMBLY FOR ATTACHMENT TO A VAN

BACKGROUND OF THE INVENTION

The present invention relates to a tent assembly which is adapted to be attached to a van-type vehicle or to be utilized as a freestanding tent. More particularly, the invention relates to a wrap-around tent assembly which may be attached to the rear and one side of a van to provide access thereto through either the rear or side door.

Tent assemblies which are attachable to a vehicle in one way or another are known in the prior art. U.S. Pat. No. 3,756,649 discloses a stand-alone tent which is adapted to be attached to an open door of various different types of vehicles. The tent is completely self-supporting and freestanding and includes an integral collar around the tent door which may be inserted into the open door of the vehicle and retained in place with an adjustable retaining frame. The retaining frame and collar are detachable from the vehicle, leaving the tent in a freestanding position. However, by adapting the tent to be attached to various types of vehicles, such as a camper, van station wagon and travel trailer illustrated in the patent, wide variations in the collar retainer frame mechanism are required.

U.S. Pat. No. 4,729,594 shows a collapsible tent which is mounted to the rear of a van-type vehicle. The tent assembly is deployed from a folded position in a storage compartment on the floor of the van and is attached to an extensible framework which is pulled out through the open rear door. The tent always remains attached to the vehicle and is not self-supporting without such attachment.

U.S. Pat. No. 3,968,809 shows a tent assembly which is attached to the rear door opening of a van and suspended from the rear of the vehicle. The tent is always attached directly to the vehicle and is not self-supporting. The tent includes a collar which is adapted to completely surround the outside of the van adjacent the rear door opening and to be tightened there around with a drawstring.

U.S. Pat. Nos. 4,462,631 and 4,099,534 disclose tent assemblies which are attached to and extend from the side of a van-type vehicle. Both assemblies are also attached to the roof of the vehicle for storage and deployment. Neither of these tent assemblies is capable of stand-alone use detached from the vehicle.

U.S. Pat. Nos. 3,923,336; 2,829,661 and 2,204,432 all show tent like shelters which extend from and are supported by a vehicle and positioned adjacent one vehicle door. None of these shelter assemblies is capable of independent stand-alone use.

Prior art tent assemblies which are attachable to a vehicle are all characterized by one or more deficiencies. These include attachment to only one vehicle door opening, lack of detachability from the vehicle for freestanding use, cumbersome constructions which are difficult to store, restriction of access through the door to which they are attached, and restrictions on other utilitarian features of the vehicle.

SUMMARY OF THE INVENTION

The present invention is directed to a camping tent assembly, particularly adapted for attachment to a van, which is free from all of the noted deficiencies in prior art constructions. The tent assembly defines a generally L-shaped enclosure including integrally attached roof, side walls and floor. The pair of side walls defining the interior of the L are attached directly to the rear and one side of the van to provide partial support for the tent. The remaining outer side walls are supported in a conventional manner, such as with tent poles and guy lines. The interior side walls may be detached from the van, the van moved away from the tent, and additional tent supports installed to provide a fully functional freestanding tent.

The interior side walls which are attached to the vehicle preferably extend from the front of the rear side door along the side and around the rear of the van to completely enclose the rear side door and the rear door. Each of the interior side walls includes an opening corresponding to the adjacent vehicle door opening such that access to and from the tent from and to the vehicle is available through either door. Each of the interior side wall openings is provided with a sealing collar adapted to extend into its respective door opening to seal the interface therebetween. Suitable fasteners may be used to demountably secure the collar to the interior of the vehicle.

With the tent attached to the van and fully erected, the side and rear doors of the van are each capable of being opened through its respective opening in the interior side wall into the interior of the tent. When the interior tent walls are detached from the van and the van moved away, the wall openings may be closed with a suitable zip-in door panel.

When the tent assembly is used with a conventional conversion van, a portable galley unit may be utilized to provide a fully self-sufficient accommodation for living, sleeping and cooking. The galley is preferably positioned in the rear of the van adjacent the rear door so that it is accessible from inside the tent when the rear door is open. The galley may include any convenient arrangement of storage, food preparation, cooking and cleaning accessories. Full accessibility to the interior of the van from inside the tent through the side door is always maintained.

DETAILED DESCRIPTION OF THE PREFERRED EMBODIMENT

Figure 1:
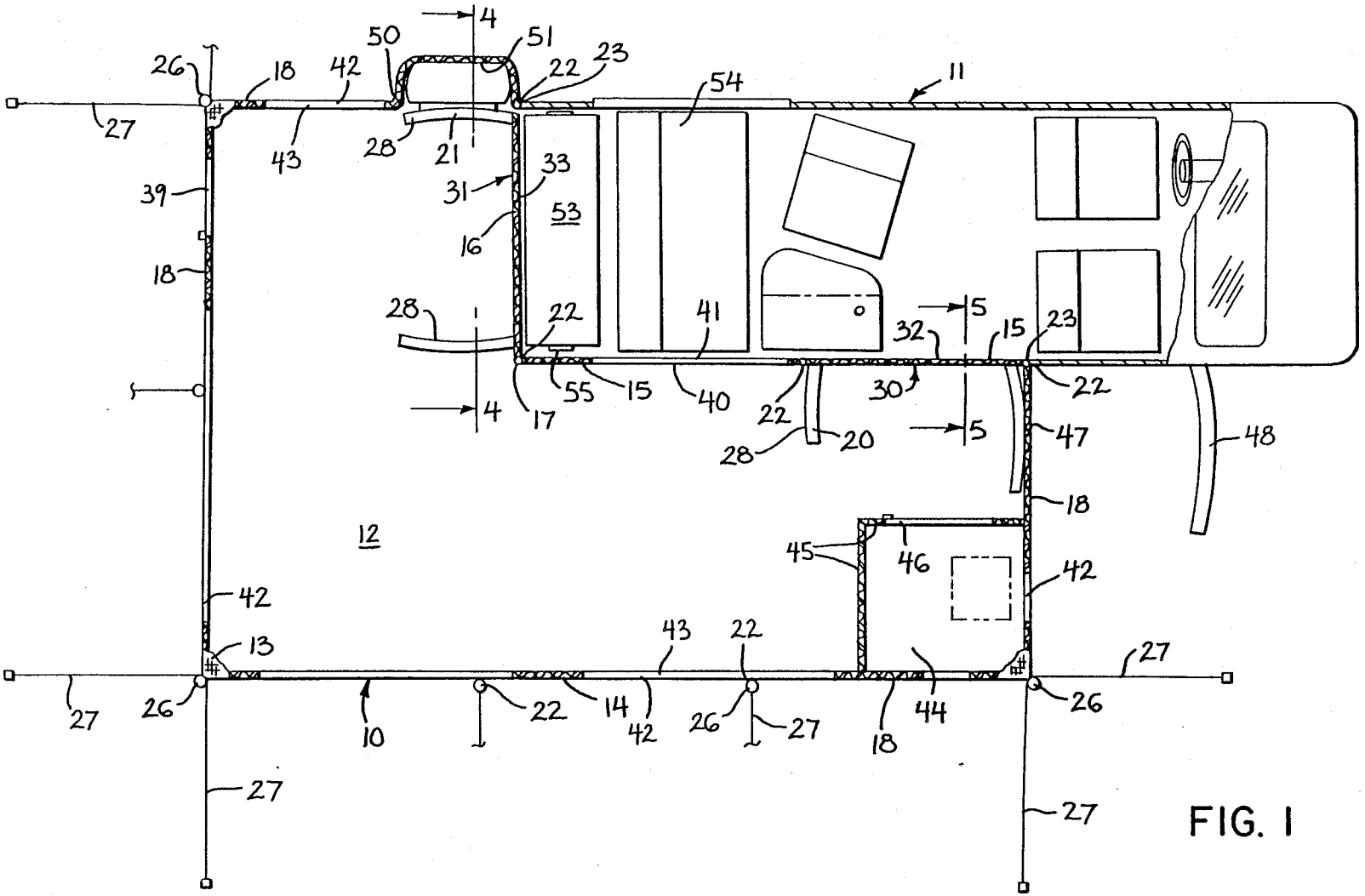
FIG. 1 a top plan view in section showing the tent assembly of the present invention attached to a van.
Figure 2:
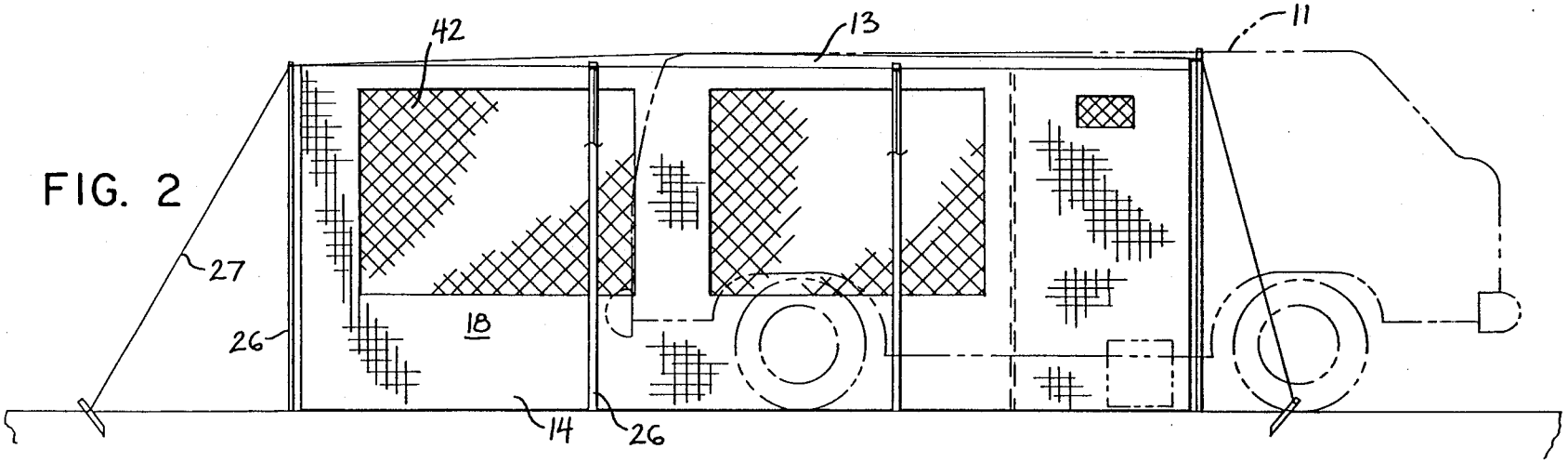
FIG. 2 is a side elevation of the tent assembly of FIG. 1.

A tent assembly 10 is particularly adapted for attachment to and use in conjunction with a conventional van-type vehicle 11, such as the popular conversion vans. The tent 10 is of a generally L-shape in plan view and includes a waterproof floor 12, a water repellent roof 13, and side walls 14 extending between the floor and roof to provide a completely enclosed tent.

The side walls on the interior of the L comprise an interior side wall 15 and an interior rear wall 16 integrally joined at a common vertical edge to form an interior corner 17. The interior side walls 15 and 16 are disposed generally perpendicular to one another. The interior of the L defines a space for a portion of the van 11 which space, as will be described in greater detail hereinafter, may be vacated by driving the van away with the tent retained in its full freestanding position.

The tent side walls 14 also include a plurality of exterior side walls 18 extending around the exterior of the tent from the forward end of the interior side wall 15 to the outside end of the interior rear wall 16 to complete the general L-shaped tent configuration.

Figure 6:
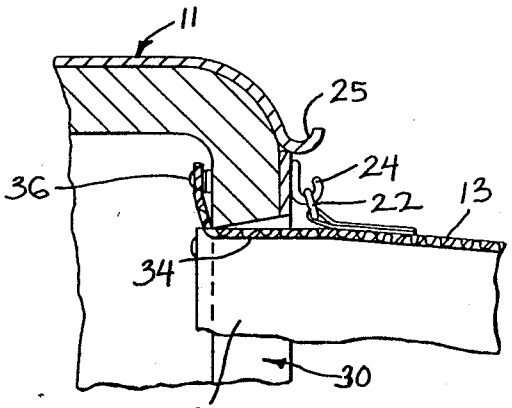
FIG. 6 is enlarged detail of a portion of FIG. 5.
Figure 3:
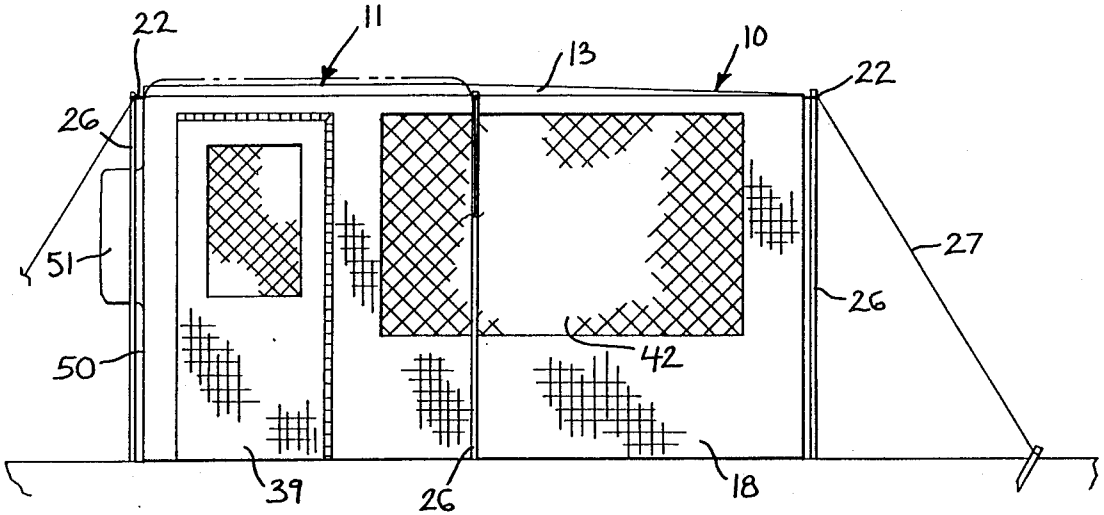
FIG. 3 is a side elevation of the tent assembly of FIG. 1.

The tent is preferably sized such that the interior side wall 15 extends from just forward of the rear side door 20 of the van to the rear end of the van and the interior rear wall 16 extends across the whole width of the rear of the van, completely covering the rear door 21. The interior side and rear walls 15 and 16 have a height approximately equal to the height of the van 11 or, preferably, just slightly less than the van height. A series of conventional D-rings 22 is attached at spaced intervals along the upper horizontal edges of the interior side walls 15 and 16 at or near their connection to the roof 13. Preferably, there is a D-ring 22 attached at the interior corner 17, each of the exterior corners 23 defined by the interior side walls 15 and 16 and the integrally attached adjacent exterior side wall 18, and at an intermediate portion along the top of the interior side wall 15. As best shown in FIG. 6, a series of hooks 24 are attached to the van just under the drip trough 25 and at locations corresponding to the positions of the D-rings 22. Attachment of the D-rings 22 to the hooks 24 provides direct support for a part of the tent. The remainder of the tent is supported in a conventional manner utilizing vertical tent poles 26 and associated guy lines or ropes 27. The tent poles 26 may be attached at their upper ends to D-rings 22 attached at the exterior corners 23 and also suitable intermediate positions, as shown. The exterior side walls 18 are preferably dimensioned to provide the roof 13 with a pitch running downwardly to the rear and laterally of the van 11.

The rear door 21 and rear side door 20 of most passenger vans typically include two hinged door panels 28 adapted to close along a common seam. The door panels 28 swing outwardly in a conventional manner and, with respect to the rear side door 20 particularly, the door panels may be of unequal widths. Some vans are equipped with a rear side door which is openable by sliding it rearwardly along the side of the van such that there is no hinged connection.

Figure 5:
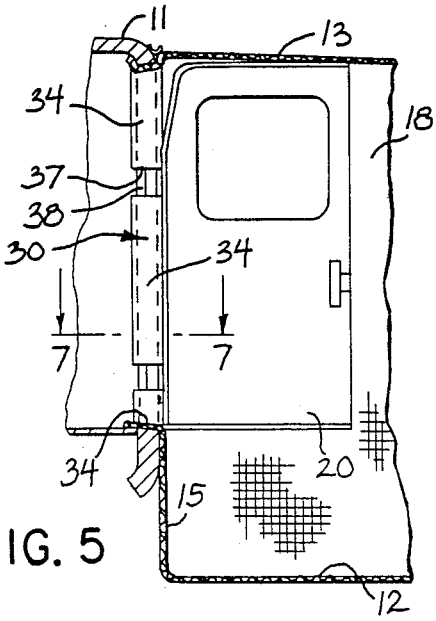
FIG. 5 is vertical section taken on line 5—5 of FIG. 1.
Figure 7:
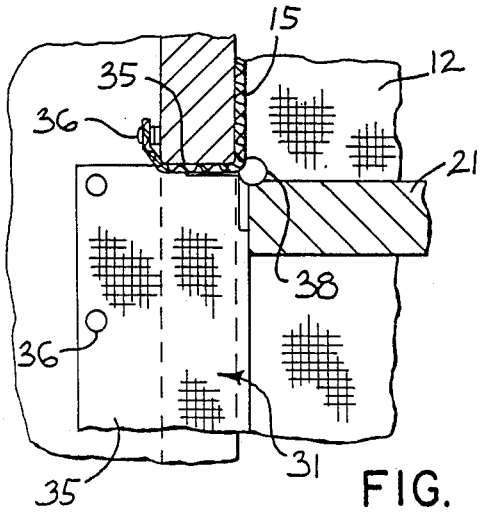
FIG. 7 is a horizontal section taken on line 7—7 of FIG. 5.

The interior side wall 15 is provided with a side wall opening 30 approximately equal in size and shape to the opening provided by the rear side door 20. Similarly, the interior rear wall 16 is provided with a rear wall opening 31 of a size and shape corresponding to the opening of the rear door 21. The side and rear wall openings 30 and 31 are each provided with an appropriate zippered closure 32 and 33, respectively, for use when the tent is detached from the van. Attached to the exterior of the interior side and rear walls 15 and 16, surrounding the side and rear wall openings 30 and 31, are similar sealing collars 34 and 35, respectively, as best shown in FIGS. 5-7. When the interior side walls 15 and 16 are attached to the van and the side and rear doors 20 and 21 opened into the tent, the collars 34 and 35 may be inserted through the door openings and into the interior of the van to seal the interface between the van and the interior side walls. The outside surfaces of the collars 34 and 35 and the adjacent interior surfaces of the van are preferably provided with demountable fasteners, such as snaps 36, to secure the collars in place. Each of the sealing collars 34 and 35 is continuous around its respective wall opening 30 and 31 except for the cut-out portions 37 at the location of the door hinges 38.

When it is desired to utilize the van 11 and move it away from the tent, the sealing collars 34 and 35 are detached from the interior of the van and D-rings 22 are detached from the hooks 24 on the side and rear of the van. The part of the tent supported by the van is allowed to temporarily sag, although the tent will remain substantially supported by the tent poles and guy ropes 27 around the exterior side walls 18. After the van has been moved away from the tent, tent poles 26 may be attached to the D-rings 22 previously attached to the hooks 24 and additional guy ropes 27 attached to the newly positioned poles to fully support the tent in a freestanding orientation. The side and rear wall openings 30 and 31 may be suitably closed with the zippered closures 32 and 33, respectively, as desired.

In a preferred construction, the interior side wall 15 of the tent is provided with a clear plastic window 40 of a size and in a position corresponding generally to the size and location of the rear side window 41 of the van which is generally located just behind the rear side door 20. In addition, the exterior side walls 18 of the tent may be provided with a number of screen windows 42, each of which includes an interior zippered flap 43 so the screen window may be closed to the elements. The rear wall 18 may also be provided with a zippered door 39. The tent also preferably includes a small toilet room 44 in a corner defined by the intersection of two exterior side walls 18. The toilet room 44 is enclosed by a pair of interior panels 45, one of which is provided with a suitable zippered door 46.

Referring again to FIG. 1, the interior side wall 15 terminates forwardly at its juncture with the laterally extending forward exterior wall 47 which extends generally perpendicular to the van. The front door 48 of the van is thus available for entry to and exit from the van and the tent. The rear exterior side wall 50, extending rearwardly from the interior rear wall 16 may include an integral round wheel sized receptacle 51 to accommodate the spare tire 52 typically attached to the rear door 21. Alternately, the exterior rear side wall 50 may simply be wrapped around the spare tire and allowed to bulge sightly outwardly. In one preferred version, the tent 10 is made to a size which extends approximately 6 feet laterally and rearwardly of the van. A tent of this size provides sufficient interior space to easily accommodate a table and chairs and/or a number of cots and sleeping bags.

Figure 4:
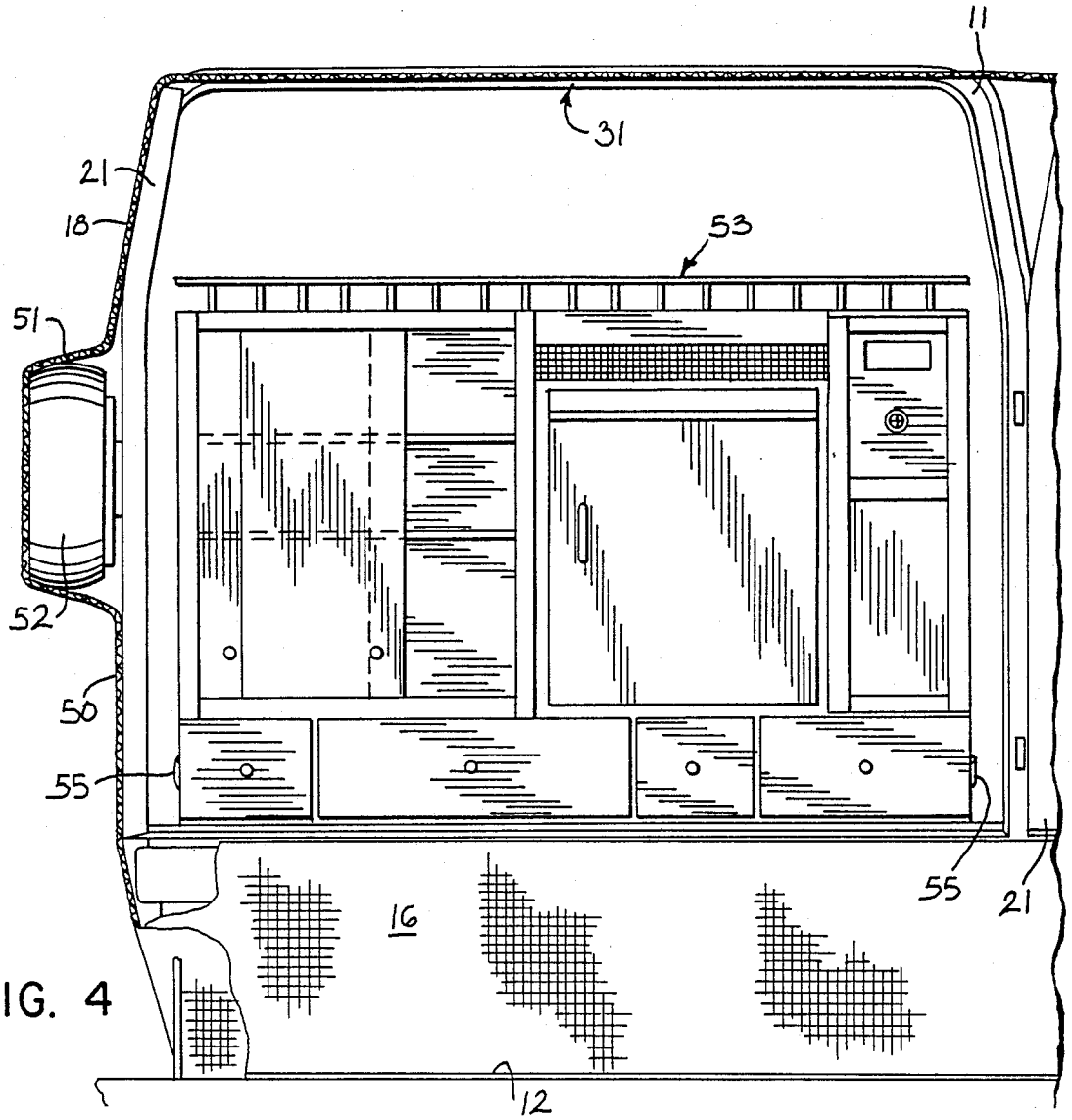
FIG. 4 is vertical section taken on line 4—4 of FIG. 1.

To provide a complete camping assembly, a portable galley unit 53, as best shown in FIGS. 1 and 4, is installed in the rear of the van just inside the rear door and behind the rear seat/bed 54. The galley unit 53 faces rearwardly to be accessible from outside the van and inside the tent when the rear door 21 is open. The galley preferably includes space for a refrigerator or ice box and water tank and includes a number of storage shelves. The lower portion of the unit includes drawers for the storage of a cookstove, and miscellaneous cooking utensils. Additional storage space in the galley unit may be made accessible from the front (behind the rear seat/bed inside the van when said seat/bed is in its bed position). The galley unit is made just slightly narrower than the width of the back door opening, such that it may be readily slid into and out of the van. Lifting handles 55 mounted on the galley unit assist in this.

The combination of the tent 10, van 11, and galley unit 53 provides a complete camping assembly to accommodate the living, sleeping and cooking needs of a number of people. The tent is easily detachable from the van and fully functional as a freestanding tent after the van has been moved away. The galley unit may be left in the van or removed for temporary storage and use inside the tent. By providing a tent with a wrap-around L-shaped configuration, a larger area with direct access to the van is available and, in addition, accessibility to the vehicle through two separate doors preserves virtually the totaly utility of the vehicle for camping use. One person can erect or take down the tent in about 15 minutes, and the tent can be rolled up in a bundle small enough to be stored under the rear seat 54 in the van. Thus, no external storage for the tent, atop the van or otherwise, is required.

Various modes of carrying out the present invention are contemplated as being within the scope of the following claims particularly pointing out and distinctly claiming the subject matter which is regarded as the invention.

I claim:

1. A tent assembly for attachment to a van-type vehicle or for freestanding use comprising:

a generally L-shaped enclosure including a roof, side walls, and a floor;

said side walls including a pair of interior walls on the interior of the L shaped enclosure disposed generally perpendicular to one another and having a common vertical edge defining an interior corner and opposite vertical edges, and outer wall means extending between the opposite vertical edges of said interior side walls;

said interior side walls having upper horizontal edges;

demountable attachment means on the upper horizontal edges of the interior side walls for attachment to the rear and one side of the vehicle to support a part of the tent assembly;

first tent support means operatively attached to the outer wall means for supporting the remainder of the tent assembly; and, second tent support means adapted to cooperate with said demountable attachment means in the absence of said vehicle to support said part of the tent.

2. The invention as set forth in claim 1 wherein said vehicle includes a rear side door having a generally vertically disposed forward edge on said one side and a rear door, and wherein said assembly further comprises:

one of said interior side walls extending from the forward edge of said rear side door to said common vertical edge between said one and the rear side of the vehicle;

the other of said interior side walls extending across the rear of the vehicle;

a side opening in said one interior side wall for said rear side door; and, a rear opening in said other interior side wall for said rear door.

3. The invention as set forth in claim 2 wherein each of said side wall openings includes a sealing collar disposed around the opening and extending into its respective door opening to seal the interface between the vehicle and said interior side walls.

4. The invention as set forth in claim 3 including fastener means demountably fastening each sealing collar to the interior of the vehicle adjacent its respective door opening.

5. The invention as set forth in claim 2 wherein said outer wall means comprises a plurality of exterior side walls having adjacent interconnected vertical edges defining exterior corners, the end ones of which exterior walls are each attached by one edge to one of said opposite vertical edges of said interior side walls to define an additional pair of exterior corners.

6. The invention as set forth in claim 5 wherein said first tent support means comprises a tent pole and guy rope for each exterior corner.

7. The invention as set forth in claim 6 wherein said second tent support means comprises a tent pole and guy rope for each of said interior corners and said additional exterior corners.

8. The invention as set forth in claim 2 wherein said demountable attachment means comprises a metal ring disposed at each of said additional exterior corners and interior corner.

9. The invention as set forth in claim 8 including a plurality of metal hooks attached to the vehicle for supporting said rings.

10. A portable camping assembly comprising in combination:

a van-type vehicle having a side door on one side and a rear door in the rear of the vehicle;

a portable galley unit positioned in the vehicle adjacent the rear door and accessible from outside the vehicle when said rear door is open;

an L-shaped tent having a roof and a floor interconnected by a plurality of vertical side wall panels to define a completely enclosed interior;

the interior of the L including a pair of said side wall panels demountably attached to and supported by the vehicle;

said pair of interior side wall panels being joined by a common vertical edge and extending along the rear and said one side of the vehicle and over said doors; and, an opening in each of said pair of interior side wall panels for one of said doors and providing direct access to the interior of the vehicle from the tent.

11. The assembly as set forth in claim 10 including substitute tent support means for supporting said interior pair of side wall panels when said panels are detached from the vehicle and the vehicle is moved away from the tent.

12. The assembly as set forth in claim 11 wherein said vehicle side door comprises a rear side door.

13. The assembly as set forth in claim 12 wherein each of said doors is openable through its respective interior side wall panel opening into the interior of the tent when said panels are attached to the vehicle.

14. The assembly as set forth in claim 10 wherein said galley unit includes a refrigerator, stove and water supply.

* * * * *